US009746869B2

(12) United States Patent
Jaffari

(10) Patent No.: US 9,746,869 B2
(45) Date of Patent: Aug. 29, 2017

(54) SYSTEM AND METHOD FOR GENERATING CASCODE CURRENT SOURCE BIAS VOLTAGE

(71) Applicant: SAMSUNG DISPLAY CO., LTD., Yongin, Gyeonggi-Do (KR)

(72) Inventor: Nasrin Jaffari, San Jose, CA (US)

(73) Assignee: Samsung Display Co., Ltd., Yongin-si (KR)

( * ) Notice: Subject to any disclaimer, the term of this patent is extended or adjusted under 35 U.S.C. 154(b) by 259 days.

(21) Appl. No.: 14/548,187

(22) Filed: Nov. 19, 2014

(65) Prior Publication Data

US 2015/0160679 A1 Jun. 11, 2015

Related U.S. Application Data

(60) Provisional application No. 61/912,475, filed on Dec. 5, 2013.

(51) Int. Cl.

| | |
|---|---|
| ***G05F 3/26*** | (2006.01) |
| ***G05F 3/20*** | (2006.01) |
| *G05F 3/24* | (2006.01) |

(52) U.S. Cl.

CPC ..... *G05F 3/262* (2013.01); *G05F 3/205* (2013.01); *G05F 3/24* (2013.01); *G05F 3/242* (2013.01); *G05F 3/26* (2013.01)

(58) Field of Classification Search

CPC ... G05F 3/24; G05F 3/242; G05F 3/26; G05F 3/262; G05F 3/205

See application file for complete search history.

(56) References Cited

U.S. PATENT DOCUMENTS 5,680,038 A 10/1997 Fiedler
5,959,446 A * 9/1999 Kuckreja ..... G05F 3/262 323/315
6,169,456 B1 1/2001 Pauls
(Continued)

FOREIGN PATENT DOCUMENTS

CN 101881984 A 11/2010
CN 102681582 A 9/2012
(Continued)

OTHER PUBLICATIONS

EPO Search Report dated Apr. 7, 2015, for corresponding European Patent application 14196532.7, (6 pages).

*Primary Examiner* — Fred E Finch, III
*Assistant Examiner* — Rafael O. De León Domenech
(74) *Attorney, Agent, or Firm* — Lewis Roca Rothgerber Christie LLP

(57) ABSTRACT

A circuit includes: a cascode current source comprising: a current mirror transistor; and a cascode transistor; and a bias circuit coupled to the cascode current source, the bias circuit comprising: a current source; a first transistor coupled in series to the current source to form a first current path through the current source and the first transistor; a second transistor coupled in series to the current source; and a third transistor coupled in series to the second transistor and the current source to form a second current path through the current source and the second and third transistors, wherein the third transistor has a channel size greater than a channel size of the second transistor by a multiple determined according to a design factor of the bias circuit.

20 Claims, 5 Drawing Sheets

(56) References Cited

U.S. PATENT DOCUMENTS

| | | | | |
|---|---|---|---|---|
| 2007/0170977 | A1 | 7/2007 | Von Thun | |
| 2007/0200632 | A1 | 8/2007 | Jung et al. | |
| 2008/0284405 | A1* | 11/2008 | Lorenz | G05F 3/26 323/315 |
| 2010/0327843 | A1 | 12/2010 | Tesu et al. | |
| 2013/0027135 | A1 | 1/2013 | Kim et al. | |

FOREIGN PATENT DOCUMENTS

| | | | |
|---|---|---|---|
| EP | 0 322 074 | A2 | 6/1989 |
| EP | 0 643 478 | A1 | 3/1995 |

* cited by examiner

SYSTEM AND METHOD FOR GENERATING CASCODE CURRENT SOURCE BIAS VOLTAGE

CROSS-REFERENCE TO RELATED APPLICATION

The present application claims priority to and the benefit of U.S. Provisional Application Ser. No. 61/912,475, filed Dec. 5, 2013, entitled "POWER SUPPLY INSENSITIVE CASCODE BIAS CIRCUIT," the entire content of which is incorporated herein by reference.

BACKGROUND

The present invention relates to a system and method for generating a cascode current source bias voltage.

Current sources operate in electronic circuits to provide or receive an electrical current. An ideal current source has a large output impedance such that it provides a constant current output regardless of the voltage applied across the ideal current source. Thus, an ideal current source has infinite output impedance. In practical application, however, all current sources have a finite output impedance such that the current output by a current source inherently varies in accordance with variations in the voltage across the current source, due to the finite output impedance of real-world components. Certain circuit structures may enable improved output impedance, but may increase voltage overhead, and may be less robust against power supply variations.

An ideal current source, however, has a relatively low voltage overhead, such that the minimum voltage $V_{out_min}$ at which the current source can operate is low. Further, an ideal current source is robust against power supply variations, such that variations in power supply voltages have a lower impact on the operation of the current source.

In many different fields, therefore, there is a desire for a current source having a relatively high output impedance, while still having a relatively low minimum voltage $V_{out_min}$ at which the current source can operate, and while still being robust against power supply variations.

The above information disclosed in this Background section is only for enhancement of understanding of the background of the invention and therefore it may contain information that does not form the prior art that is already known to a person of ordinary skill in the art.

SUMMARY

Aspects of embodiments of the present invention include a system and method for generating a cascode current source bias voltage with relatively low sensitivity to power supply variations.

According to some embodiments of the present invention, a circuit includes: a cascode current source comprising: a current mirror transistor; and a cascode transistor; and a bias circuit coupled to the cascode current source, the bias circuit comprising: a current source; a first transistor coupled in series to the current source to form a first current path through the current source and the first transistor; a second transistor coupled in series to the current source; and a third transistor coupled in series to the second transistor and the current source to form a second current path through the current source and the second and third transistors, wherein the third transistor has a channel size greater than a channel size of the second transistor by a multiple determined according to a design factor of the bias circuit.

The design factor may include a minimum supplied voltage at which the current source operates.

The design factor may include a reference voltage across the current source.

The design factor may include a threshold voltage of the second transistor.

The multiple may be equal to $$\left(\frac{V_{OV}}{V_{DD_min} - V_{REF} - 2V_{th} - V_{OV}}\right)^2,$$

where $V_{OV}$ is a drain-to-source saturation voltage of the second transistor, $V_{DD_min}$ is a minimum supplied voltage at which the current source operates, $V_{th}$ is a threshold voltage of the second transistor, and $V_{REF}$ is a reference voltage across the current source.

A gate electrode of the of the first transistor may be coupled to a gate electrode of the current mirror transistor to provide a current mirror bias voltage to the cascode current source, and a gate electrode of the second transistor may be coupled to a gate electrode of the cascode transistor to provide a cascode bias voltage to the cascode current source.

According to some embodiments of the present invention, a bias circuit for a cascade current source, the bias circuit comprising: a current source; a first transistor coupled in series to the current source; a second transistor coupled in series to the current source; and a third transistor coupled in series to the second transistor and the current source, wherein the third transistor has a channel size greater than a channel size of the second transistor by a multiple determined according to a design factor of the bias circuit.

The design factor may include a minimum supplied voltage at which the current source operates.

The design factor may include a reference voltage across the current source.

The design factor may include a threshold voltage of the second transistor.

The multiple may be equal to $$\left(\frac{V_{OV}}{V_{DD_min} - V_{REF} - 2V_{th} - V_{OV}}\right)^2,$$

where $V_{OV}$ is a drain-to-source saturation voltage of the second transistor, $V_{DD_min}$ is a minimum supplied voltage at which the current source operates, $V_{th}$ is a threshold voltage of the second transistor, and $V_{REF}$ is a reference voltage across the current source.

The first transistor may include: a first electrode coupled to the current source to receive a reference current; a second electrode coupled to a voltage source; and a gate electrode coupled to the first electrode of the first transistor; the second transistor may include: a first electrode coupled to the current source to receive the reference current; a second electrode; and a gate electrode coupled to the first electrode of the second transistor; the third transistor may include: a first electrode coupled to the second electrode of the second transistor; a second electrode coupled to the voltage source; and a gate electrode coupled to the first electrode of the third transistor.

A first current path may be formed through the current source and the first transistor, and a second current path may be formed through the current source, the second transistor, and the third transistor.

According to some embodiments of the present invention, a method of generating a bias voltage for a cascade current source using a bias circuit, the method comprising: providing a current through a first current path comprising a current source and a first transistor coupled in series to the current source to generate a current mirror bias voltage at a gate electrode of the first transistor; and providing the current through a second current path comprising the current source, a second transistor, and a third transistor to generate a cascode bias voltage at a gate electrode of the second transistor, wherein the third transistor has a channel width greater than a channel width of the second transistor by a multiple determined according to a design factor of the bias circuit.

The first transistor, the second transistor, and the third transistor may be diode-coupled.

The design factor may include a minimum supplied voltage at which the current source operates.

The design factor may include a reference voltage across the current source.

The design factor may include a threshold voltage of the second transistor.

The multiple may be equal to $$\left(\frac{V_{OV}}{V_{DD_min} - V_{REF} - 2V_{th} - V_{OV}}\right)^2,$$

where $V_{OV}$ is a drain-to-source saturation voltage of the second transistor, $V_{DD_min}$ is a minimum supplied voltage at which the current source operates, $V_{th}$ is a threshold voltage of the second transistor, and $V_{REF}$ is a reference voltage across the current source.

The first transistor may include: a first electrode coupled to the current source to receive a reference current; a second electrode coupled to a voltage source; and a gate electrode coupled to the first electrode of the first transistor; the second transistor may include: a first electrode coupled to the current source to receive the reference current; a second electrode; and a gate electrode coupled to the first electrode of the second transistor; the third transistor may include: a first electrode coupled to the second electrode of the second transistor; a second electrode coupled to the voltage source; and a gate electrode coupled to the first electrode of the third transistor.

BRIEF DESCRIPTION OF THE DRAWINGS

A more complete appreciation of the present invention, and many of the attendant features and aspects thereof, will become more readily apparent as the invention becomes better understood by reference to the following detailed description when considered in conjunction with the accompanying drawings in which like reference symbols indicate like components.

DETAILED DESCRIPTION

Figure 1B:
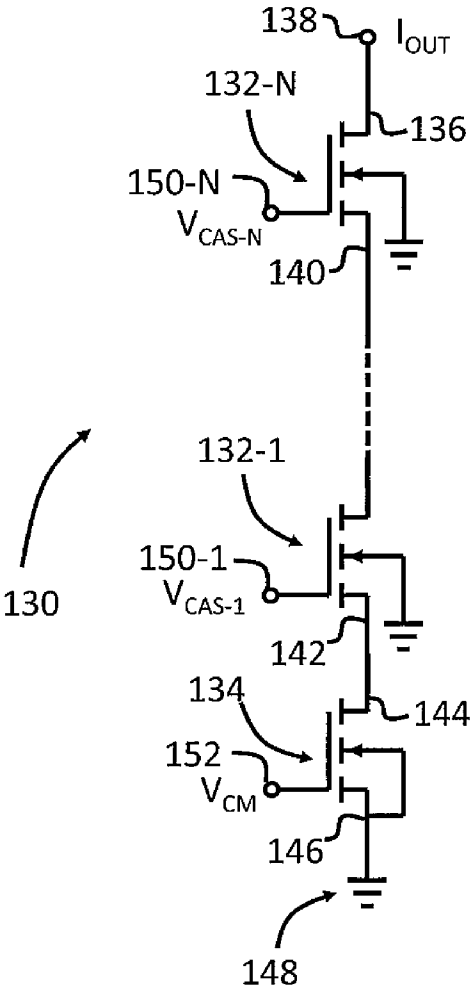
FIGS. 1A and 1B illustrate schematic diagrams of example cascode current source circuits, according to embodiments of the present invention.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey some of the aspects and features of the present invention to those skilled in the art. Accordingly, processes, elements, and techniques that are not necessary to those having ordinary skill in the art for a complete understanding of the aspects and features of the present invention are not described with respect to some of the embodiments of the present invention. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises" and/or "comprising," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the present invention refers to "one or more embodiments of the present invention." Also, the term "exemplary" is intended to refer to an example or illustration.

It will be understood that when an element or layer is referred to as being "on," "connected to," "coupled to," or "adjacent to" another element or layer, it can be directly on, connected to, coupled to, or adjacent to the other element or layer, or one or more intervening elements or layers may be present. However, when an element or layer is referred to as being "directly on," "directly connected to," "directly coupled to," or "immediately adjacent to" another element or layer, there are no intervening elements or layers present.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Generally speaking, a current source has a large output impedance such that the current does not change as the voltage across the current source changes. Additionally, a current source may operate with a low voltage overhead such that the current source can operate with relatively low power supply. A cascode circuit structure may be utilized in a current source to increase output impedance, but may also increase voltage overhead and the amount of power to drive the current source due to the use of additional transistors.

Compared to a single-transistor current source, a cascode current source (CCS) will generally operate with a higher output impedance, and reduced voltage swing due to stacking transistors in series. Additionally, CCS bias circuits may be less robust against power supply variations and may generally cause the CCS to be less robust.

Embodiments of the present invention operate to generate bias voltages for a cascode current source using a bias circuit that has relatively low voltage overhead, and is relatively robust against power supply variations.

Figure 1A:
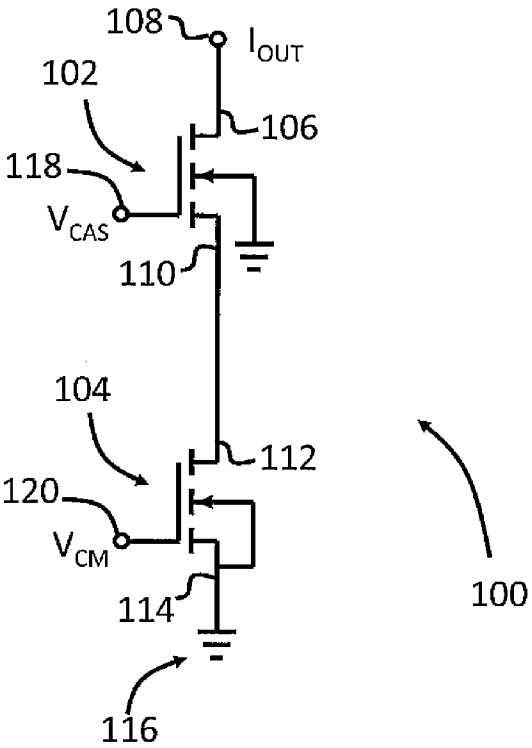

FIG. 1A illustrates a single-stage CCS 100, with a single cascode transistor 102 coupled in series with a current mirror transistor 104. A first electrode (e.g., a source or drain electrode) 106 of the transistor 102 is coupled to an output 108 of the CCS 100, which provides an output current $I_{out}$. A second electrode (e.g., a drain or source electrode) 110 of the transistor 102 is coupled to a first electrode 112 of the transistor 104. A second electrode 114 is coupled to a voltage source 116 (e.g., supplying a ground voltage). A gate electrode 118 of the transistor 104 is coupled to a cascode transistor bias voltage source supplying a cascade bias voltage $V_{CAS}$, and a gate electrode 120 of the transistor 104 is coupled to a current mirror bias voltage source supplying a current mirror bias voltage $V_{CM}$.

Additional cascode transistors may be utilized to further increase the output impedance and reduce voltage swing. For example, FIG. 1B illustrates a multi-stage CCS 130, with a plurality of cascode transistors 132-1 through 132-N. The plurality of cascode transistors 132-1 through 132-N are coupled in series with each other, and are further coupled in series with a current mirror transistor 134. A first electrode (e.g., a source or drain electrode) 136 of the transistor 132-N is coupled to an output 138 of the CCS 130, which provides an output current $I_{out}$. A second electrode (e.g., a drain or source electrode) 140 of the transistor 132-N is coupled to a first electrode of the next cascode transistor 132-(N−1), and so on, such that each of the cascode transistors 132-1 through 132-N is coupled in series. An electrode (e.g., a drain or source electrode) 142 of the cascode transistor 132-1 is coupled to a first electrode (e.g., a source or drain electrode) 144 of the current mirror transistor 134. A second electrode (e.g., a drain or source electrode) 146 of the transistor 134 is coupled to a voltage source 148 (e.g., supplying a ground voltage). Gate electrodes 150-1 through 150-N of each of the respective cascode transistors 132-1 through 132-N are coupled to corresponding cascode transistor bias voltage sources supplying corresponding bias voltages $V_{CAS\text{-}1}$ through $V_{CAS\text{-}N}$. A gate electrode 152 of the transistor 134 is coupled to a current mirror bias voltage source supplying a bias voltage $V_{CM}$.

Figure 2B:
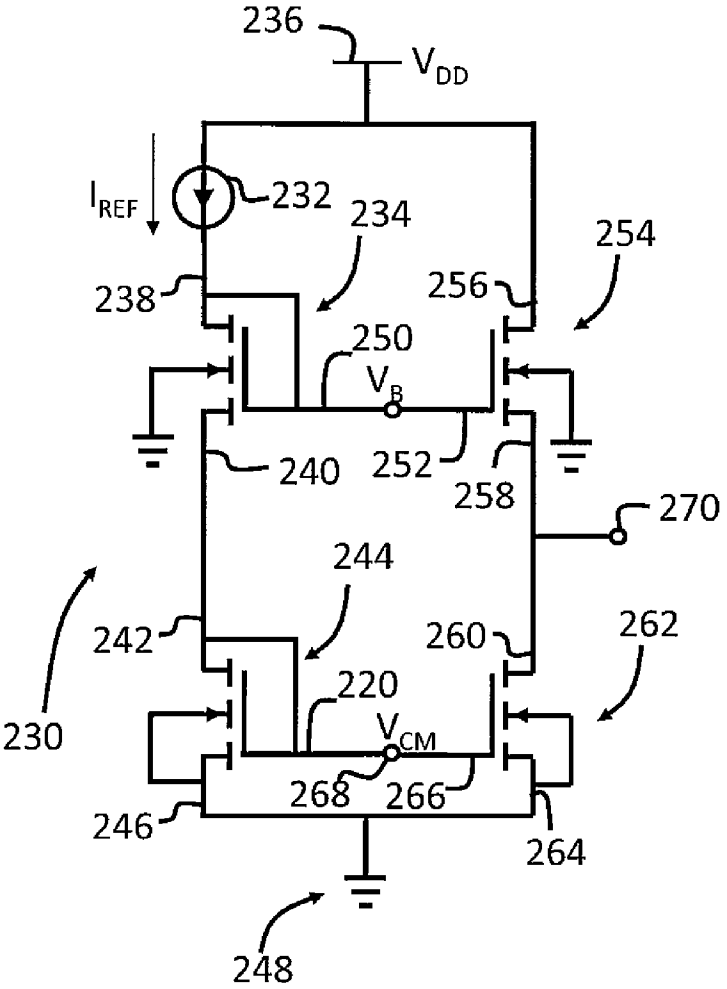
FIGS. 2A and 2B illustrate schematic diagrams of example bias circuits for a cascode current source, according to embodiments of the present invention.
Figure 2A:
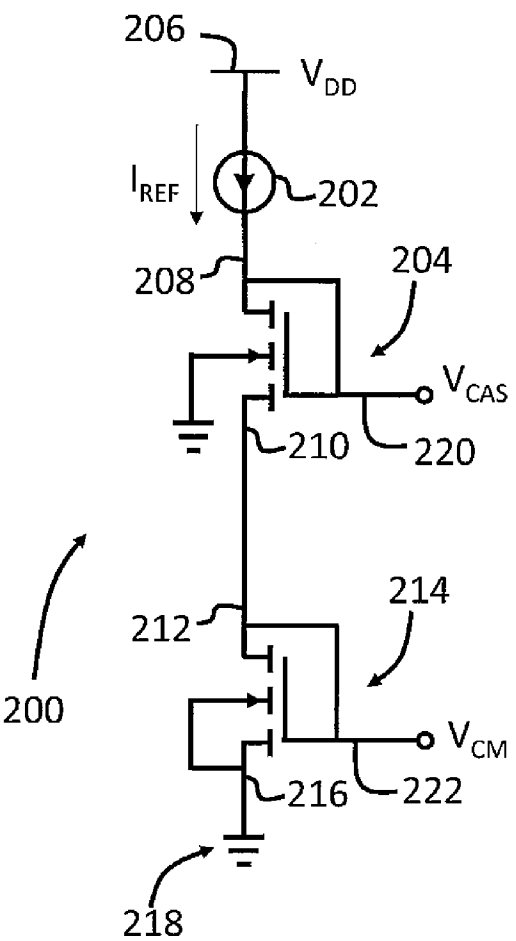

The minimum output voltage, $V_{out_min}$, at which a CCS (e.g., the CCS 100 or the CCS 130 shown in FIGS. 1A and 1B, respectively) operates is determined according to the biasing scheme of the CCS. FIGS. 2A and 2B illustrate example bias circuit configurations for providing the bias voltages $V_{CAS}$ and $V_{CM}$ to the CCS (e.g., the CCS 100 or the CCS 130).

For example, FIG. 2A illustrates a bias circuit 200 including a current source 202 electrically coupled between a first transistor 204 and a voltage source 206 supplying a voltage (e.g., $V_{DD}$) to the current source 202. The current source 202 in turn supplies a reference current $I_{REF}$ to a first electrode (e.g., a source or drain electrode) 208 of the first transistor 204. A second electrode (e.g., a drain or source electrode) 210 of the first transistor 204 is electrically coupled to a first electrode (e.g., a source or drain electrode) 212 of a second transistor 214. A second electrode (e.g., a drain or source electrode) 216 of the second transistor 214 is electrically coupled to a voltage source 218 (e.g., supplying a ground voltage). The first transistor 204 has a channel size W/L that is equal or substantially equal to a channel size W/L of the second transistor 214 (where the terms "W/L" or "channel size W/L" refer to the ratio of the channel width to the channel length of the corresponding transistor, which may also be referred to as the transistor's width/length ratio or simply "channel ratio").

A gate electrode 220 of the first transistor 204 is electrically coupled to the first electrode 208 of the first transistor 204 in a diode-coupled configuration. Additionally, the gate electrode 220 of the first transistor 204 may be coupled to the gate electrode of a cascode transistor (e.g., the cascode transistor 102 of the CCS 100) of a CCS to provide a cascode transistor bias voltage $V_{CAS}$ to the CCS. In the case of a CCS having a plurality of cascode transistors (e.g., the CCS 130), the bias circuit 200 may include a plurality of diode-coupled first transistors 204-1 through 204-N, with the gate electrode of the transistors 204-1 through 204-N each coupled to corresponding gate electrodes of the cascode transistors.

A gate electrode 222 of the second transistor 214 is electrically coupled to the first electrode 212 of the second transistor 214 in a diode-coupled configuration. Additionally, the gate electrode 222 may be coupled to the gate electrode of a current mirror transistor (e.g., the current mirror transistor 104 or the current mirror transistor 134) of a CCS to provide a current mirror bias voltage $V_{CM}$ to the CCS.

FIG. 2B illustrates an alternative bias circuit arrangement for a cascode current source. As shown in FIG. 2B, a bias circuit 230 includes a current source 232 electrically coupled between a first transistor 234 and a voltage source 236 supplying a voltage (e.g., $V_{DD}$) to the current source 232. The current source 232 in turn supplies a reference current $I_{REF}$ to a first electrode (e.g., a source or drain electrode) 238 of the first transistor 234. A second electrode (e.g., a drain or source electrode) 240 of the first transistor 234 is electrically coupled to a first electrode (e.g., a source or drain electrode) 242 of a second transistor 244. A second electrode (e.g., a drain or source electrode) 246 of the second transistor 244 is electrically coupled to a voltage source 248 (e.g., supplying a ground voltage). The first transistor 234 has a channel size W/4 L that is one fourth the size of a channel size W/L of the second transistor 244. A gate electrode 250 of the first transistor 234 is electrically coupled to the first electrode 238 of the first transistor 234 in a diode-coupled configuration.

The gate electrode 250 of the first transistor 234 is also coupled to a gate electrode 252 of a third transistor 254 and provides a voltage $V_B$ to the gate electrode 252 of a third transistor 254. A first electrode (e.g., a source or drain electrode) 256 of the third transistor 254 is electrically coupled to the voltage source 236 and a voltage (e.g., $V_{DD}$) is applied to the first electrode 256. A second electrode (e.g., a drain or source electrode) 258 of the third transistor 254 is coupled to a first electrode (e.g., a source or drain electrode) 260 of a fourth transistor 262. A second electrode 264 of the fourth transistor 262 is electrically coupled to the voltage source 248 (e.g., supplying a ground voltage). The third transistor 254 has a channel size W/L that is equal or substantially equal to a channel size W/L of the fourth transistor 262.

A gate electrode 266 of the fourth transistor 262 is coupled to the gate electrode 220 of the second transistor 244 and a current mirror bias voltage $V_{CM}$ is generated at a node 268 between the gate electrode 220 and the gate electrode 266. Additionally, a cascode bias voltage $V_{CAS}$ is generated at a node 270 between the second electrode 258 of the third transistor and the first electrode 260 of the fourth transistor 262.

Thus, the node 268 may be coupled to the gate electrode of a current mirror transistor (e.g., the current mirror transistor 104 or the current mirror transistor 134) of a CCS to provide a current mirror bias voltage $V_{CM}$ to the CCS. Additionally, the node 270 may be coupled to the gate electrode of a cascode transistor (e.g., the cascode transistor 102 of the CCS 100) of a CCS to provide a cascode transistor bias voltage $V_{CAS}$ to the CCS.

Referring to FIG. 2A, the minimum voltage across the current source 202, which provides the reference current $I_{REF}$, is a reference voltage $V_{REF}$ corresponding to the voltage drop across the current source 202. Additionally, the gate-to-source voltage of a transistor, $V_{GS}$, is equal to the sum of the threshold voltage of the transistor and the drain-to-source saturation voltage of the transistor according to equation 1, below:

$$V_{GS}=V_{th}+V_{OV} \tag{1}$$

where $V_{th}$ is the transistor threshold voltage, and $V_{OV}$ is the drain-to-source saturation voltage.

The voltage drop across a diode-coupled transistor is the drain-to-source voltage $V_{DS}$, which is also the gate-to-source voltage $V_{GS}$, because the gate and source are electrically coupled in a diode-coupled configuration. Thus, the voltage drop across a diode-coupled transistor is represented according to equation 2, below:

$$V_{DS}=V_{GS}=V_{th}+V_{OV} \tag{2}$$

Additionally, the overdrive voltage (or drain-to-source saturation voltage) of a transistor is inversely proportional to the channel size W/L of the transistor, according to equation 3, below:

$$V_{OV}=\sqrt{\frac{I}{\left(\frac{W}{L}\right)\mu C_{OX}}} \tag{3}$$

Further, the minimum output voltage, $V_{out_min}$, at which a CCS can operate is equal to the difference between the cascode bias voltage $V_{CAS}$ and the threshold voltage $V_{th}$ according to equation 4, below:

$$V_{out_min}=V_{CAS}-V_{th} \tag{4}$$

Thus, referring to FIG. 2A above, the voltage drop across the current source 202 is equal to $V_{REF}$, the voltage drop across the transistor 204 is equal to $V_{th}+V_{OV}$, and the voltage drop across the transistor 214 is equal to $V_{th}+V_{OV}$. Thus, the minimum voltage $V_{DD_min}$ at which the bias circuit 200 can operate is equal to the sum of these values according to equation 5, below:

$$V_{DD_min}=2V_{th}+2V_{OV}+V_{REF} \tag{5}$$

Similarly, the voltage drop across the current source 232 in FIG. 2B is equal to $V_{REF}$, the voltage drop across the transistor 234 is equal to $V_{th}+2V_{OV}$, and the voltage drop across the transistor 244 is equal to $V_{th}+V_{OV}$. Accordingly, the minimum voltage $V_{DD_min}$ at which the bias circuit 230 can operate can be calculated according to equation 6, below:

$$V_{DD_min}=2V_{th}+3V_{OV}+V_{REF} \tag{6}$$

For a one-stage CCS (e.g., the CCS 100) utilizing the bias circuit 200 shown in FIG. 2A, the minimum output voltage, $V_{out_min}$, at which a CCS operates can be calculated according to equation 7, below:

$$V_{out_min}=V_{th}+2\times V_{OV} \tag{7}$$

In the case of the bias circuit 230 shown in FIG. 2B, the minimum output voltage, $V_{out_min}$, at which a CCS operates may be reduced to $2\times V_{OV}$, but the bias circuit 230 may be less robust against power supply variations compared to the structure of the bias circuit 200.

Figure 3A:
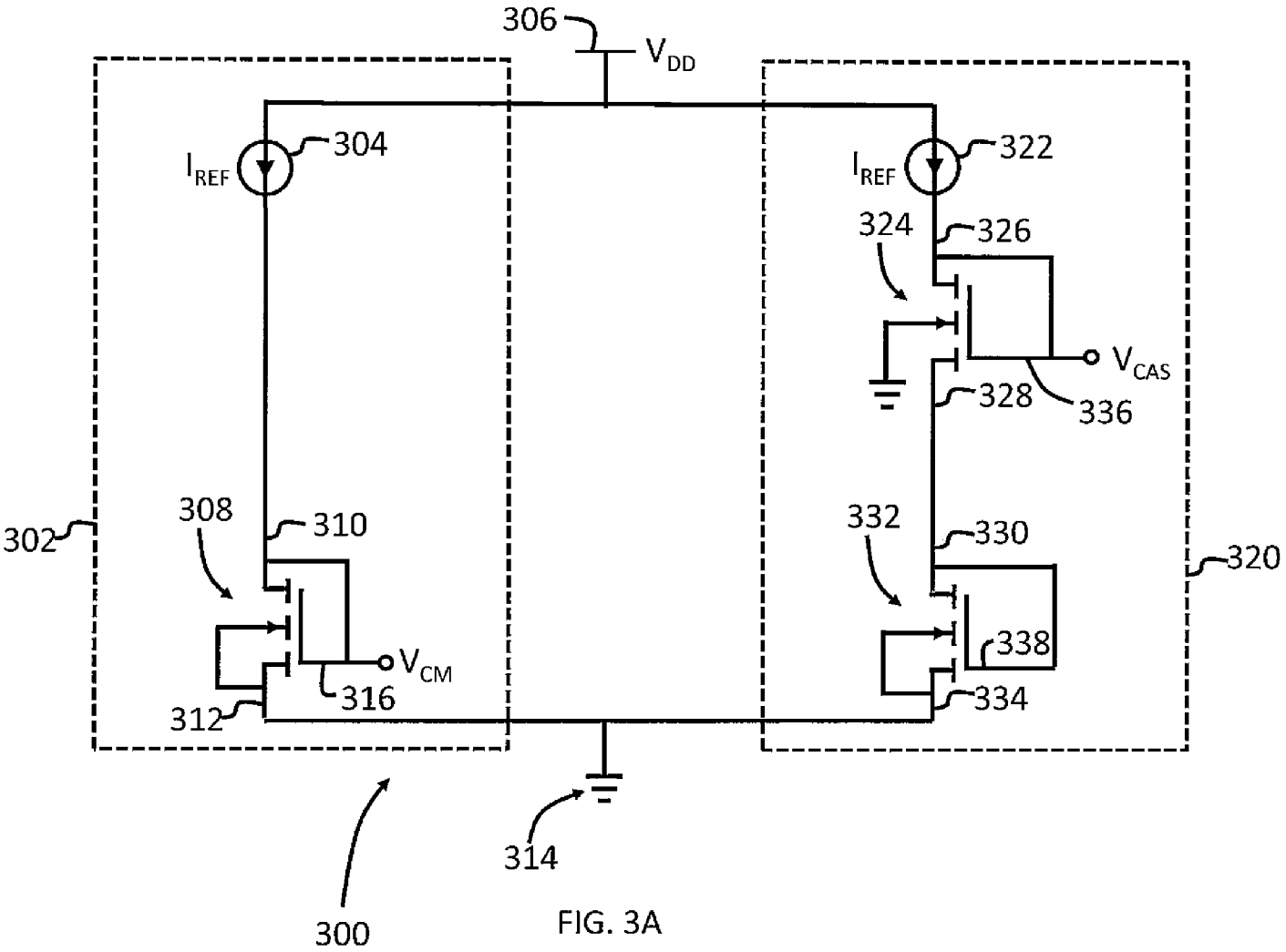
FIGS. 3A and 3B illustrate schematic diagrams of alternative example bias circuits for a cascade current source, according to embodiments of the present invention.
Figure 3B:
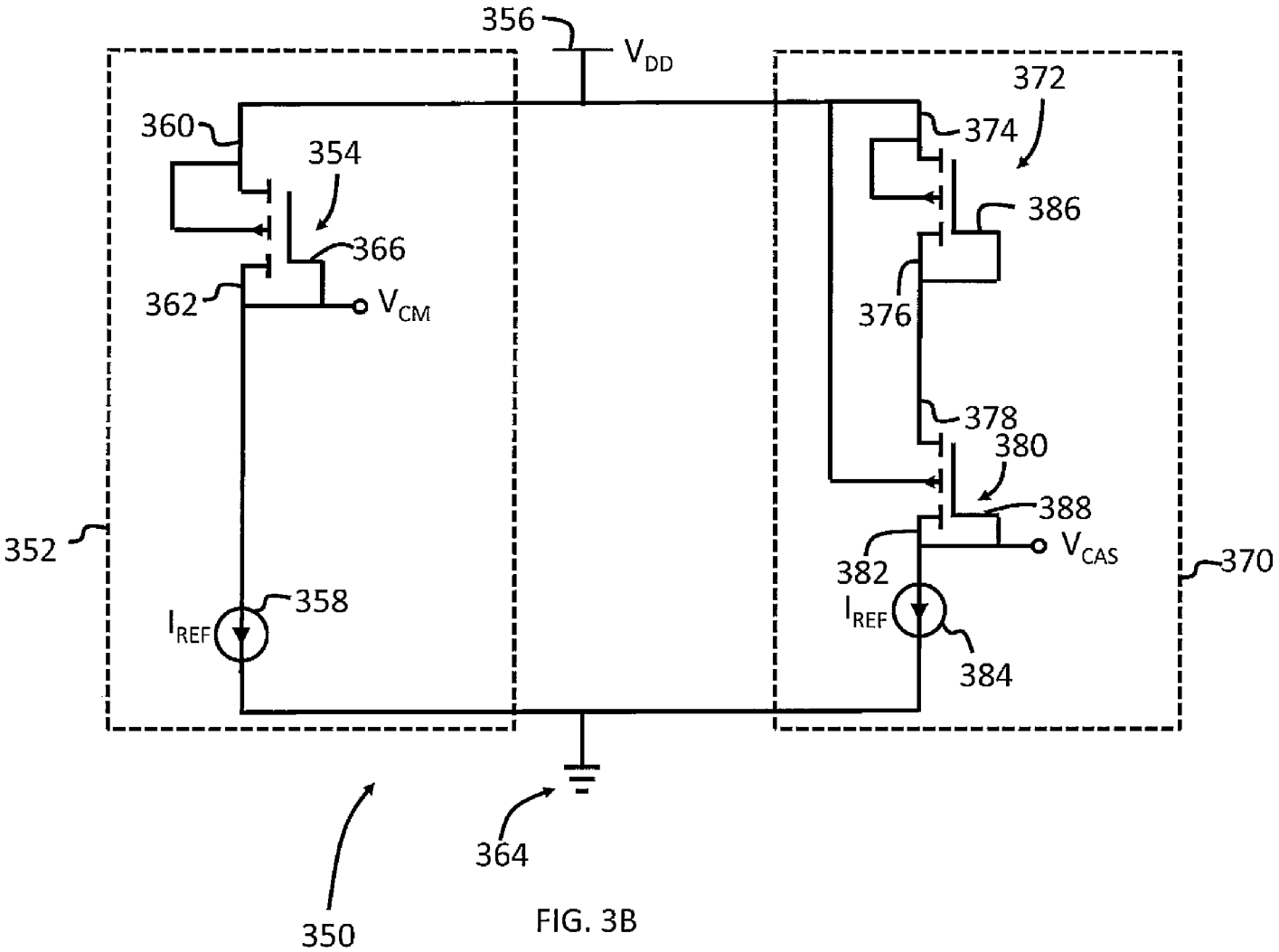

FIGS. 3A and 3B illustrate an alternative bias circuit configuration for a CCS that may reduce the minimum output voltage, $V_{out_min}$, at which a CCS operates compared to the bias circuit 200, while also being more robust against power supply variations compared to the bias circuits 200 and 230. FIG. 3A illustrates a bias circuit 300 in an n-channel MOSFET (NMOS) configuration. The bias circuit 300 includes a first current path 302 for generating a current mirror bias voltage $V_{CM}$ for a CCS. The first current path 302 of the bias circuit 300 includes a current source 304 coupled between a voltage source 306 and a first transistor 308, where the first transistor 308 is an NMOS transistor. The voltage source 306 applies a voltage (e.g., $V_{DD}$) to the current source 304, which in turn applies a reference current $I_{REF}$ to a first electrode (e.g., a drain electrode) 310 of the first transistor 308. A second electrode (e.g., a source electrode) 312 of the first transistor 308 is coupled to a voltage source 314 (e.g., supplying a ground voltage). A gate electrode 316 of the first transistor 308 is coupled to the first electrode 310 of the first transistor 308 in a diode-coupled configuration. The gate electrode 316 of the first transistor 308 may then be coupled to a gate electrode of a current mirror transistor (e.g., the transistor 104 or the transistor 134) of a CCS to provide the current mirror bias voltage $V_{CM}$ to the CCS.

The bias circuit 300 further includes a second current path 320 for generating a cascode bias voltage $V_{CAS}$ for a CCS. The second current path 320 of the bias circuit 300 includes a current source 322 coupled between the voltage source 306 and a second transistor 324, where the second transistor 324 is an NMOS transistor. For convenience of illustration, the current source 322 and the current source 304 are illustrated as two separate current sources. According to some embodiments the current sources 322 and 304, however, may be the same current source configured to provide the same reference current $I_{REF}$ to the first current path 302 and the second current path 320. The voltage source 306 applies a voltage (e.g., $V_{DD}$) to the current source 322, which in turn applies a reference current $I_{REF}$ (equal to the reference current applied by the current source 304) to a first electrode (e.g., a drain electrode) 326 of the second transistor 324. A second electrode (e.g., a source electrode) 328 of the second transistor 324 is coupled to a first electrode (e.g., a drain electrode) 330 of a third transistor 332, and a second electrode (e.g., a source electrode) 334 of the third transistor 332 is coupled to the voltage source 314 (e.g., supplying a ground voltage).

A gate electrode 336 of the second transistor 324 is coupled to the first electrode 326 of the second transistor 324 in a diode-coupled configuration. Similarly, a gate electrode 338 of the third transistor 332 is coupled to the first electrode 330 of the third transistor 332 in a diode-coupled configuration.

The first transistor 308 has a channel size W/L equal or substantially equal to a channel size W/L of the second transistor 324. The third transistor 332 has a channel size M×W/L that is a multiple M times larger than the channel size W/L of the second transistor 324, where the multiple M is greater than 1 and is determined according to the design factors or constraints of the corresponding CCS, as will be discussed in more detail below. The gate electrode 336 of the second transistor 324 may be coupled to a gate electrode cascode transistor (e.g., the transistor 118 in FIG. 1A) of a CCS to provide the cascode bias voltage $V_{CAS}$ to the CCS.

FIG. 3B illustrates a bias circuit 350 in a p-channel MOSFET (PMOS) configuration. The bias circuit 350 includes a first current path 352 for generating a current mirror bias voltage $V_{CM}$ for a CCS. The first current path 352 of the bias circuit 350 includes a first transistor 354, which is a PMOS transistor, coupled between a voltage source 356 and a current source 358. The voltage source 356 applies a voltage (e.g., $V_{DD}$) to a first electrode (e.g., a source electrode) 360 of the first transistor 354. A second electrode (e.g., a drain electrode) 362 is coupled to the current source 358, which in turn generates a reference current $I_{REF}$. The current source 358 is further coupled to a voltage source 364 (e.g., supplying a ground voltage).

A gate electrode 366 of the first transistor 354 is coupled to the second electrode 362 of the first transistor 354 in a diode-coupled configuration. The gate electrode 366 of the first transistor 354 may then be coupled to a gate electrode of a current mirror transistor (e.g., the transistor 104 or the transistor 134) of a CCS to provide the current mirror bias voltage $V_{CM}$ to the CCS.

The bias circuit 350 further includes a second current path 370 for generating a cascode bias voltage $V_{CAS}$ for a CCS. The second current path 370 of the bias circuit 350 includes a second transistor 372, which is a PMOS transistor. A first electrode (e.g., a source electrode) 374 of the second transistor 372 is coupled to the voltage source 356 to receive a voltage (e.g., $V_{DD}$). A second electrode (e.g., a drain electrode) 376 of the second transistor 372 is coupled to a first electrode (e.g., a source electrode) 378 of a third transistor 380, which is a PMOS transistor. A second electrode (e.g., a drain electrode) 382 of the third transistor 380 is coupled to a current source 384, which in turn generates a reference current $I_{REF}$. The current source 384 is further coupled to the voltage source 364 (e.g., supplying a ground voltage). For convenience of illustration, the current source 384 and the current source 358 are illustrated as two separate current sources. According to some embodiments, however, the current sources 384 and 358 may be the same current source configured to provide the same reference current $I_{REF}$ for the first current path 352 and the second current path 370.

A gate electrode 386 of the second transistor 372 is coupled to the second electrode 376 of the second transistor 372 in a diode-coupled configuration. Similarly, a gate electrode 388 of the third transistor 380 is coupled to the second electrode 382 of the third transistor 380 in a diode-coupled configuration. The gate electrode 388 of the third transistor 380 may then be coupled to a gate electrode of a cascode transistor (e.g., the transistor 102) of a CCS to provide the cascode bias voltage $V_{CAS}$ to the CCS.

The first transistor 354 has a channel size W/L equal or substantially equal to a channel size W/L of the third transistor 380. The second transistor 372 has a channel size M×W/L that is a multiple M times larger than the channel size W/L of the third transistor 380, where the multiple M is greater than 1 determined according to the design of the corresponding CCS as will be discussed in more detail below. The gate electrode 388 of the third transistor 380 may be coupled to a gate electrode cascode transistor (e.g., the transistor 118 in FIG. 1A) of a CCS to provide the cascode bias voltage $V_{CAS}$ to the CCS.

Referring to FIG. 3A, and equations 1-4, above, the voltage drop across the current source 304 and the current source 322 is equal to $V_{REF}$, the voltage drop across the first transistor 308 and the second transistor 324 is equal to the sum of $V_{th}$ and $V_{OV}$, and the voltage drop across the third transistor 332 is equal to $V_{th}+V_{OV}/\sqrt{(M)}$. Thus, the minimum voltage $V_{DD_min}$ at which the bias circuit 300 can operate can be calculated according to equation 8, below:

$$V_{DD_min} = 2V_{th} + V_{OV}\left(1 + \frac{1}{\sqrt{M}}\right) + V_{REF} \tag{8}$$

The minimum voltage $V_{DD_min}$ at which the bias circuit 350 in FIG. 3B can operate is also represented according to equation 8. Thus, for a one-stage CCS (e.g., the CCS 100) utilizing the bias circuit 300 shown in FIG. 3A or the bias circuit 350 in FIG. 3B, the minimum output voltage $V_{out_min}$ at which a CCS operates can be calculated according to equation 9, below:

$$V_{out_min} = V_{th} + V_{OV}\left(1 + \frac{1}{\sqrt{M}}\right) \tag{9}$$

where M is greater than 1 representing a multiple of the channel size W/L of the transistors 308, 324, 354, and 380.

Thus, as illustrated in equation 9, the bias circuits 300 and 350 may reduce the minimum output voltage $V_{out_min}$ at which a CCS can operate compared to the structure of the bias circuit 200 shown in FIG. 2A. Additionally, the bias circuits 300 and 350 may be more robust against power supply variations, leading to more robust CCS operation, compared to the structures of the bias circuits 200 and 230 shown in FIGS. 2A and 2B, respectively.

Table 1, below, illustrates example values of $V_{out_min}$ and $V_{DD_min}$ corresponding to the bias circuits 200, 230, 300, and 350, respectively, using example values of 0.3 volts, 0.2 volts, and 0.25 volts for $V_{th}$, $V_{OV}$, and $V_{REF}$ in equations 4-9, above.

TABLE 1

| | $V_{out_min}$ | $V_{DD_min}$ |
|---|---|---|
| Bias Circuit 200 | 0.7 volts | 1.25 volts |
| Bias Circuit 230 | 0.4 volts | 1.55 volts |
| Bias Circuits 300 and 350 | 0.56 volts | 1.11 volts |

Thus, as illustrated in table 1, the bias circuits 300 and 350 have a lower $V_{DD_min}$ (1.11 volts using the example values for $V_{th}$, $V_{OV}$, and $V_{REF}$), when compared to the bias circuit 200 and the bias circuit 230 (which have a $V_{DD_min}$ of 1.25 and 1.55, respectively, using the example values far $V_{th}$, $V_{OV}$, and $V_{REF}$). Further the bias circuits 300 and 350 have an improved $V_{out_min}$ (0.56 volts using the example values for $V_{th}$, $V_{OV}$, and $V_{REF}$) with respect to the bias circuit 200 (which has a $V_{out_min}$ of 0.7 volts using the example values for $V_{th}$, $V_{OV}$, and $V_{REF}$).

Figure 4:
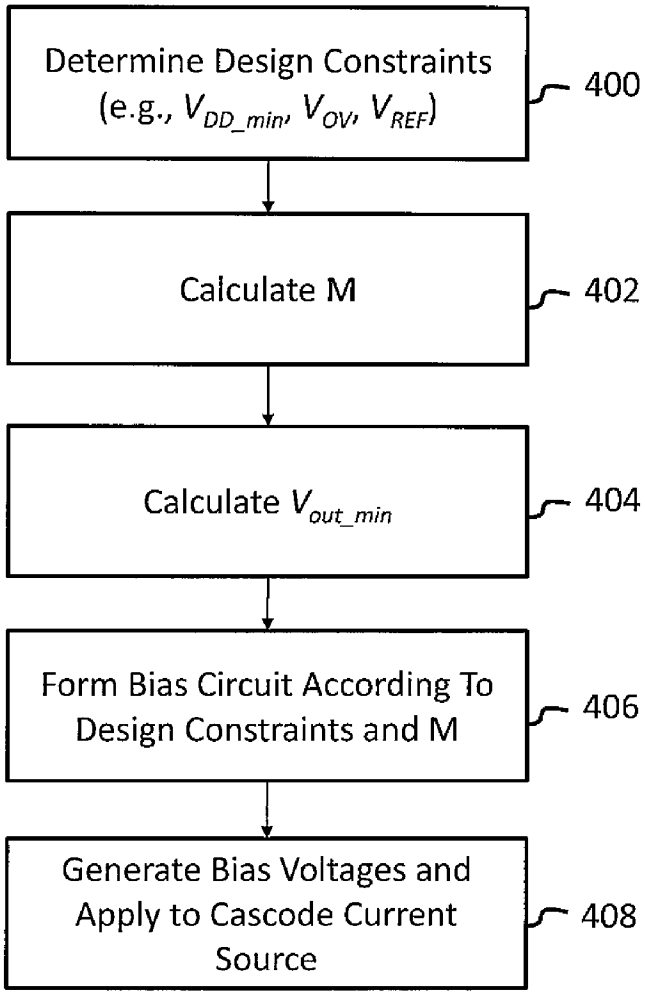
FIG. 4 illustrates a flow chart of a method for generating a bias voltage for a cascode current source, according to embodiments of the present invention.

FIG. 4 illustrates a flow chart of a method for generating a bias voltage for a CCS. At block 400, the design factors or constraints of the bias circuit, such as $V_{DD_min}$, $V_{OV}$, and $V_{REF}$ are determined. The value of $V_{DD_min}$ is determined according to the technology, IR drop, power supply noise, and other relevant design factors that may influence the minimum voltage at which the bias circuit can operate. $V_{OV}$ is determined according to the maximum capacitance loading tolerance from the current source, because the smaller the value of $V_{OV}$, the larger the channel size of the transistor may be, which may increase the capacitance of the transistor. $V_{REF}$ is determined according to the overdrive of the reference current.

Once the design factors or constraints are established, the value of the multiple M can be calculated based on equation 8, according to the following equation 10:

$$M = \left(\frac{V_{OV}}{V_{DD_min} - V_{REF} - 2V_{th} - V_{OV}}\right)^2 \tag{10}$$

where M is greater than 1, and is a multiple for increasing the channel size M×W/L of the transistor 332 or 372 relative to the channel size W/L of the transistors 308, 324, 354 and 380.

At block 404, the minimum output voltage, $V_{out_min}$, at which the cascode current source can operate can be calculated based on M and the other design constraints according to equation 11, below:

$$V_{out_min} = V_{th} + V_{OV}\left(1 + \frac{1}{\sqrt{M}}\right) \tag{11}$$

Once the various design factors or constraints are determined, and once the value of M and are calculated, the bias circuit 300 or 350 for a CCS is formed, at block 406, depending on the values of $V_{DD_min}$, $V_{OV}$, $V_{REF}$, M and $V_{out_min}$.

At block 408, the current mirror and cascode bias voltages are generated using the bias circuit and applied to the CCS.

According to embodiments of the present invention, a cascode current source bias circuit includes a first diode-coupled transistor (e.g., the transistor 308 or the transistor 354) in series with a reference current source (e.g., the current source 304 or the current source 354), where the first transistor has a channel size W/L, and the gate electrode of the first transistor may be coupled to a gate electrode of a current mirror transistor of a CCS to provide a current mirror bias voltage to the CCS. Additionally, the cascode current source bias circuit includes a second diode-coupled transistor (e.g., the transistor 324 or the transistor 380) in series with a third diode-coupled transistor (e.g., the transistor 332 or the transistor 372) and the reference current source. The second diode-coupled transistor has a channel size W/L equal or substantially equal to the channel size W/L of the first transistor, and the gate electrode of the second transistor may be coupled to a gate electrode of a cascode transistor of a CCS to provide a cascode bias voltage to the CCS. The third diode-coupled transistor has a channel size M×W/L that is larger than the channel size W/L of the first and second transistors by a multiple M, where M is greater than 1, and is calculated according to the design factors or constraints of the CCS and the bias circuit. Thus, according to embodiments of the present invention, the channel width of the third diode-coupled transistor is a multiple M times larger than the channel width of the second diode-coupled transistor.

Embodiments of the present invention may enable bias voltages for a current mirror transistor and a cascode transistor in a CCS to be generated such that the minimum output voltage at which the CCS can operate is reduced relative to alternative bias circuit configurations. Additionally, the bias circuit, and therefore the CCS, may be relatively more robust against power supply variations.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A circuit comprising:

a cascode current source comprising:

a current mirror transistor; and a cascode transistor; and a bias circuit coupled to the cascode current source, the bias circuit comprising:

a current source;

a first transistor coupled in series to the current source to form a first current path through the current source and the first transistor;

a second transistor coupled in series to the current source; and a third transistor coupled in series to the second transistor and the current source to form a second current path through the current source and the second and third transistors, wherein the third transistor has a channel ratio greater than a channel ratio of each of the first transistor and the second transistor, and the channel ratio of the third transistor is greater than the channel ratio of the second transistor by a multiple determined according to a design factor of the bias circuit.

2. The circuit of claim 1, wherein the design factor comprises a minimum supplied voltage at which the current source operates.

3. The circuit of claim 1, wherein the design factor comprises a reference voltage across the current source.

4. The circuit of claim 1, wherein the design factor comprises a threshold voltage of the second transistor.

5. The circuit of claim 1, wherein the multiple is equal to $$\left(\frac{V_{OV}}{V_{DD_min} - V_{REF} - 2V_{th} - V_{OV}}\right)^2,$$

where $V_{OV}$ is a drain-to-source saturation voltage of the second transistor, $V_{DD_min}$ is a minimum supplied voltage at which the current source operates, $V_{th}$ is a threshold voltage of the second transistor, and $V_{REF}$ is a reference voltage across the current source.

6. The circuit of claim 1, wherein a gate electrode of the of the first transistor is coupled to a gate electrode of the current mirror transistor to provide a current mirror bias voltage to the cascade current source, and a gate electrode of the second transistor is coupled to a gate electrode of the cascode transistor to provide a cascode bias voltage to the cascode current source.

7. A bias circuit for a cascode current source, the bias circuit comprising:

a current source;

a first transistor coupled in series to the current source;

a second transistor coupled in series to the current source; and a third transistor coupled in series to the second transistor and the current source, wherein the third transistor has a channel ratio greater than a channel ratio of each of the first transistor and the second transistor, and the channel ratio of the third transistor is greater than the channel ratio of the second transistor by a multiple determined according to a design factor of the bias circuit.

8. The bias circuit of claim 7, wherein the design factor comprises a minimum supplied voltage at which the current source operates.

9. The bias circuit of claim 7, wherein the design factor comprises a reference voltage across the current source.

10. The bias circuit of claim 7, wherein the design factor comprises a threshold voltage of the second transistor.

11. The bias circuit of claim 7, wherein the multiple is equal to $$\left(\frac{V_{OV}}{V_{DD_min} - V_{REF} - 2V_{th} - V_{OV}}\right)^2,$$

where $V_{OV}$ is a drain-to-source saturation voltage of the second transistor, $V_{DD_min}$ is a minimum supplied voltage at which the current source operates, $V_{th}$ is a threshold voltage of the second transistor, and $V_{REF}$ is a reference voltage across the current source.

12. The bias circuit of claim 7, wherein:

the first transistor comprises:

a first electrode coupled to the current source to receive a reference current;

a second electrode coupled to a voltage source; and a gate electrode coupled to the first electrode of the first transistor;

the second transistor comprises:

a first electrode coupled to the current source to receive the reference current;

a second electrode; and a gate electrode coupled to the first electrode of the second transistor; and the third transistor comprises:

a first electrode coupled to the second electrode of the second transistor;

a second electrode coupled to the voltage source; and a gate electrode coupled to the first electrode of the third transistor.

13. The bias circuit of claim 7, wherein a first current path is formed through the current source and the first transistor, and a second current path is formed through the current source, the second transistor, and the third transistor.

14. A method of generating a bias voltage for a cascode current source using a bias circuit, the method comprising:

providing a current through a first current path comprising a current source and a first transistor coupled in series to the current source to generate a current mirror bias voltage at a gate electrode of the first transistor; and providing the current through a second current path comprising the current source, a second transistor, and a third transistor to generate a cascode bias voltage at a gate electrode of the second transistor, wherein the third transistor has a channel ratio greater than a channel ratio of each of the first transistor and the second transistor, and the channel ratio of the third transistor is greater than the channel ratio of the second transistor by a multiple determined according to a design factor of the bias circuit.

15. The method of claim 14, wherein the first transistor, the second transistor, and the third transistor are diode-coupled.

16. The method of claim 14, wherein the design factor comprises a minimum supplied voltage at which the current source operates.

17. The method of claim 14, wherein the design factor comprises a reference voltage across the current source.

18. The method of claim 14, wherein the design factor comprises a threshold voltage of the second transistor.

19. The method of claim 14, wherein the multiple is equal to $$\left(\frac{V_{OV}}{V_{DD_min} - V_{REF} - 2V_{th} - V_{OV}}\right)^2,$$

where $V_{OV}$ is a drain-to-source saturation voltage of the second transistor, $V_{DD_min}$ is a minimum supplied voltage at which the current source operates, $V_{th}$ is a threshold voltage of the second transistor, and $V_{REF}$ is a reference voltage across the current source.

20. The method of claim 14, wherein:

the first transistor comprises:

a first electrode coupled to the current source to receive a reference current;

a second electrode coupled to a voltage source; and a gate electrode coupled to the first electrode of the first transistor;

the second transistor comprises:

a first electrode coupled to the current source to receive the reference current;

a second electrode; and a gate electrode coupled to the first electrode of the second transistor; and the third transistor comprises:

a first electrode coupled to the second electrode of the second transistor;

a second electrode coupled to the voltage source; and a gate electrode coupled to the first electrode of the third transistor.

* * * * *